United States Patent [19]

Lee

[11] Patent Number: 4,660,826

[45] Date of Patent: Apr. 28, 1987

[54] FOLDING EXERCISE BIKE

[76] Inventor: Wen-Kuei Lee, P.O. Box 1-79, Taipei, Taiwan

[21] Appl. No.: 776,768

[22] Filed: Sep. 16, 1985

[51] Int. Cl.[4] ..... A63B 23/04

[52] U.S. Cl. ..... 272/73

[58] Field of Search ..... 272/73, 71; 128/25 R

[56] References Cited

U.S. PATENT DOCUMENTS

| | | | |
|---|---|---|---|
| 2,107,447 | 2/1938 | Marlowe | 272/73 |
| 3,940,128 | 2/1976 | Ragone | 272/73 |
| 4,586,706 | 5/1986 | Chen | 272/73 |

*Primary Examiner*—Richard J. Apley

*Assistant Examiner*—S. R. Crow

*Attorney, Agent, or Firm*—Fleit, Jacobson, Cohn & Price

[57] ABSTRACT

A folding exercise bike including a transmission box driven by pedals making a rotating bush at its output shaft drive a universal joint and drive a saddle supporter, thus permitting forward and backward motion of the saddle. Meanwhile, the universal joint drives connecting rods to pull a handle to turn the handle inward and outward, thus making the bike have a multifunctional exercise effect. The main frame, handle supporter and saddle supporter are also capable of being knocked down to reduce the volume of the bike for easy packing, transport and warehousing.

3 Claims, 6 Drawing Figures

FOLDING EXERCISE BIKE

BACKGROUND OF THE INVENTION

This invention relates to a folding exercise bike, more particularly to an exercise bike with a pedal driven transmission box permitting a rotating bush at its output shaft to drive a universal joint to pull a saddle supporter making forward and backward motion possible. Meanwhile, the universal joint pulls the handle to permit its inward and outward turning relative to the motion of the saddle, thus allowing the bike to have pedaling, front inclining and breast expanding exercise functions. Again, the main frame, handle supporter and saddle supporter are of a knock down type thus making packing, transport and warehousing easy to save space and cost.

The conventional exercise bike has a simple function for lower limb exercise and therefore, is less effective for body building. An improvement has been proposed to modify the simple function into a multiple one to include pedaling, breast expanding and arm exercise, such as the same applicant filed on Mar. 13, 1985 as per U.S. Ser. No. 711,142 "Two-Stage Exercise Bike". The complicated structure of such a bike has the defects such as more parts, higher cost, time-consuming assembly and maintenance, and more chance of mechanical trouble. Another defect of the conventional simple or multiple functional exercise bike is that the fixed structure needs expensive packing, transport and warehousing which incurs more expense and space requirement. Manufacturers have been making an effort to overcome such defects but without practical results.

SUMMARY OF THE INVENTION

The main object of the present invention is to provide a folding exercise bike to improve the defects of the conventional simple or multiple function exercise bikes, to provide a simple construction, low cost and to have multiple exercise functions.

Another object of the folding exercise bike of the present invention is to be able to knock down and fold main parts of the bike frame for easy packing, transport and warehousing so as to save space and cost and to increase competitive ability.

A further object of the present invention is to provide a folding exercise bike having a reduced number of parts so as to decrease the chance of trouble and maintenance difficulty.

BRIEF DESCRIPTION OF THE DRAWINGS

These and other objects, features and advantages will become more apparent from the following description taken in connection with the accompanying drawing wherein.

DESCRIPTION OF THE PREFERRED EMBODIMENTS

Figure 1:
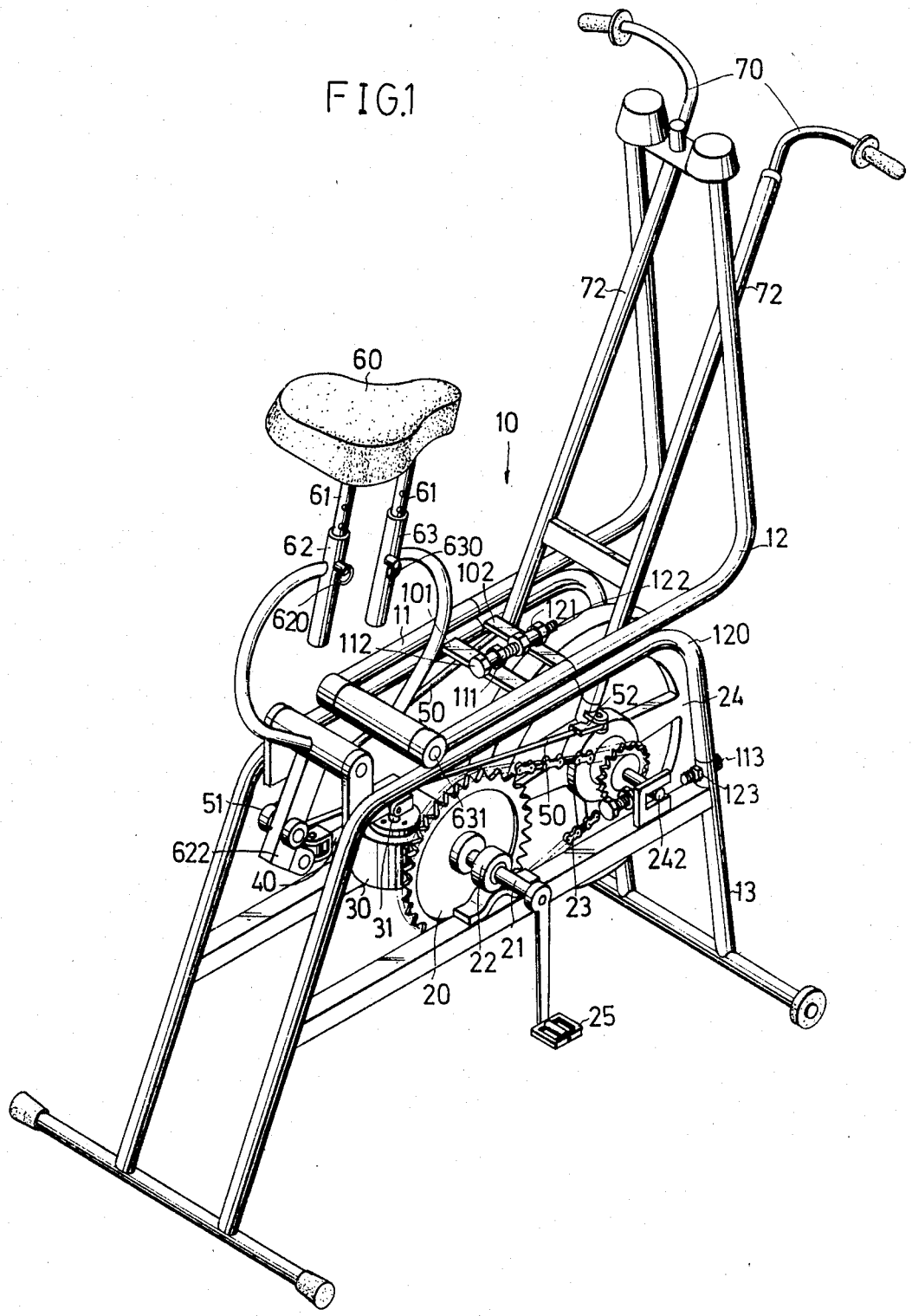
FIG. 1 depicts a perspective view of the present invention.
Figure 2:
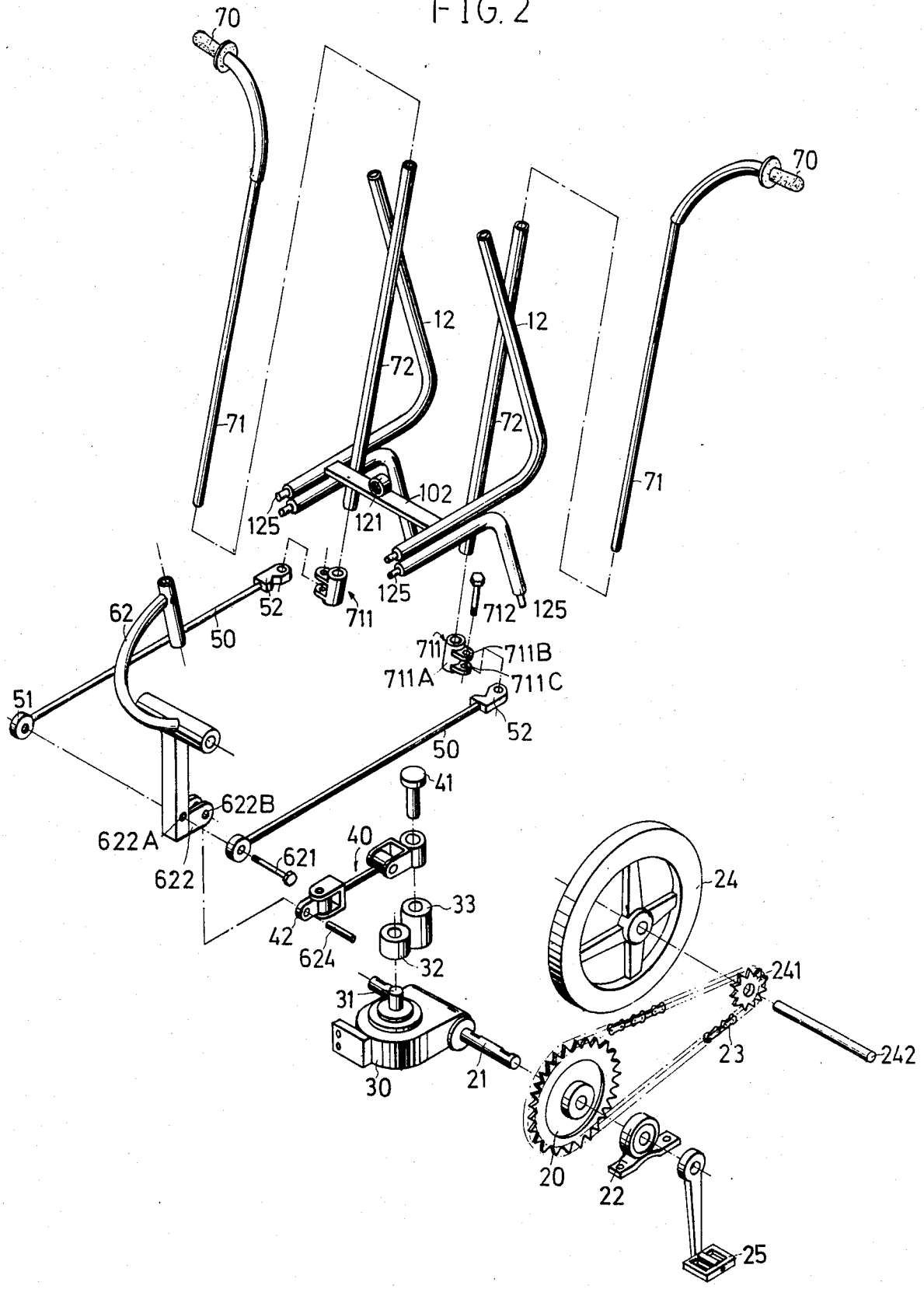
FIG. 2 depicts an exploded view in perspective of the driving mechanism of the present invention illustrating the transmission relationship thereof.
Figure 4:
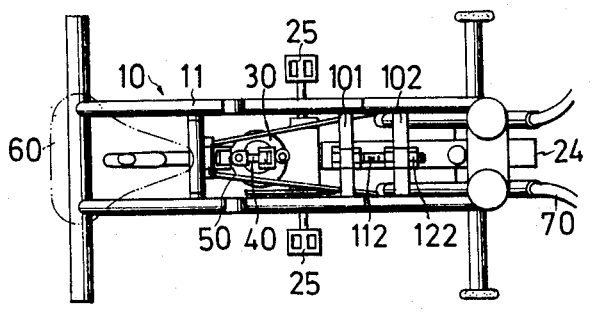
FIG. 4 depicts a top view of the present invention.

As shown in FIGS. 1, 2 and 4, the invention comprises a bike frame 10, a driving wheel 20, a transmission box 30, a universal joint means 40, connecting rods 50, 50, a saddle 60 and a handle 70. A main driving shaft 21 of the driving wheel 20 extends through transmission box 30 as an input shaft of the transmission box 30. The driving shaft 21 is rotatably fixed on the bike frame 10 by means of a bearing 22. Two pedals 25 are fixed on both ends of said shaft 21 as is conventional. Driving wheel 20 drives a small gear 241 by a chain 23 to bring a driven wheen 24 into rotation. The driven wheel 24 and the small gear 241 are fixed on the same shaft 242 which is in turn rotatably fixed at a front portion of the bike frame 10. A brake means is further provided on the outer surface of the driven wheel 24 as is conventional (not shown in drawing). On the output shaft 31 of the transmission box 30, a rotating bush 32 is fixed. At the rim of the rotating bush 32 is firmly fixed a joint bush 33 and a shaft 41 which is pivotally fixed at one end of the universal joint means 40, the lower end of the shaft 41 is in turn inserted into the joint bush 33 as shown in FIG. 2. The other end of the universal joint means 40 is connected to a lower end joint fork 622 of the saddle 60 with a joint 42 by means of a pin 624. As shown in the drawing, the joint fork 622 is rotatably connected with one end 51, 51 of two connecting rods 50, 50. The other ends 52, 52 of the two connecting rods 50, 50 are rotatably connected to the lower end of the handle bars 71, 71 with joints 711, 711, respectively. The supporters 61, 61 of the saddle 60 are inserted into the rear supporter 62 and front supporter 63, respectively. The rear supporter 62 and front supporter 63 are rotatably fixed on the top of the bike frame 10 by means of the respective hinged shaft 621 and 631, respectively. The universal joint means 40 drives the lower end joint fork 622 of the rear supporter 62, so as to make the saddle 60 move forward and backward. Handle 70 is rotatably fitted in the sleeves 72, 72 with the handle bars 71, 71. The lower ends of the handle bars 71, 71 are exposed and fixed by their respective joints 711, 711 and the joints 711, 711 each has a bush 711A to rotatably fix the lower ends of handle bars 71, 71 therein, and two projection joints 711B, 711C extending from the outer periphery of bush 711A, between which each end 52 of the connecting rod 50 is rotatably fixed thereon by means of a joint pin 712 so that the linear movement of the connecting rods 50 will make handle bars 71 have an inward and outward rotation movement.

Figure 3A:
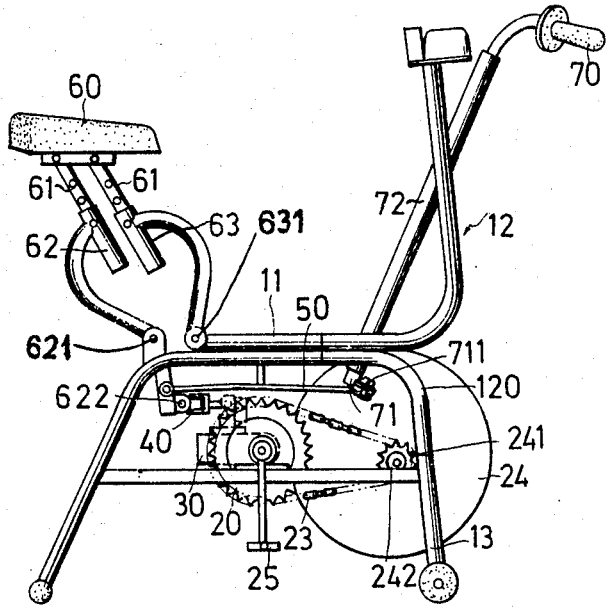
FIGS. 3A and 3B are side views showing the first and second states of the operation in accordance with the present invention, respectively.
Figure 3B:
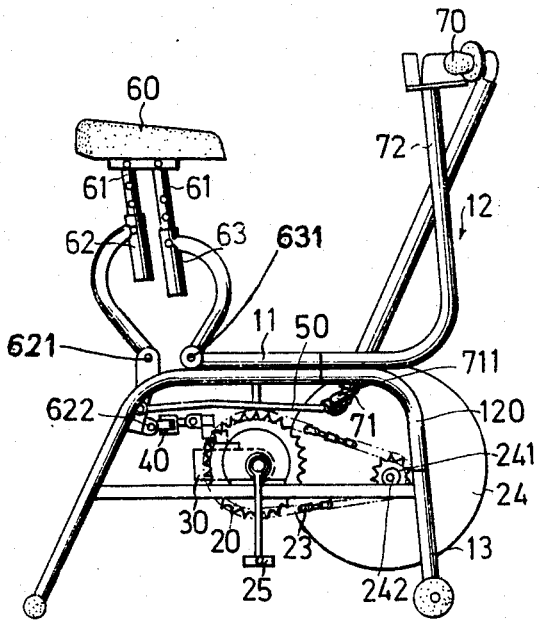

In operation, when pedalling the pedals 25, the driving shaft 21 will drive the driven wheel 24 through the driving wheel 20, chain 23 and smaller gear 241, as well as the output shaft 31 of the transmission box 30. The output shaft 31 will in turn drive rotation bush 32, joint bush 33 and the universal joint means 40. This will turn the circular movement into a linear forward and backward movement as shown in FIGS. 3A and 3B, that is, said universal joint means 40 pulls the rear supporter 62 forward gradually and the saddle 60 will move backward gradually. Meanwhile, the rear supporter 62 of the saddle drives the connecting rod 50 to move forward gradually to enable two handle bars 71, 71 to turn outward at the same time, as shown in FIG. 3A. The handle 70 is rotated outward gradually for a breast expansion exercise. On the contrary, as shown in FIG. 3B, when the universal joint means 40 pushes the rear supporter 62 of the saddle backward gradually, the saddle 60 will move forward gradually to enable handle bars 71, 71 to turn inward simultaneously. The handle 70 is rotated inward gradually for breast traction exercise. The continuous motion of pedals 25, 25 will make the above operations repeat over again and again. Therefore, the pedaling, front inclining and breast expanding exercises will function at the same time.

Figure 5:
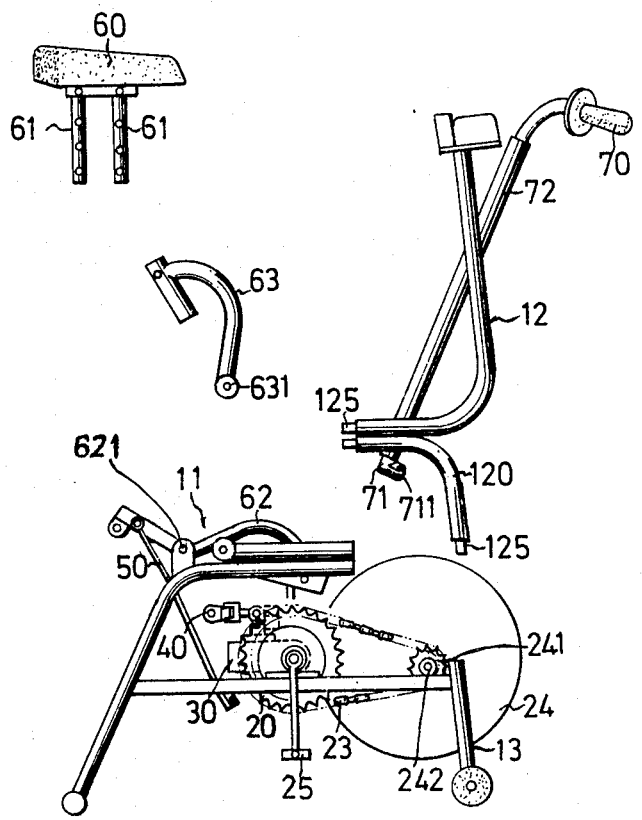
FIG. 5 depicts an exploded side view of the present invention illustrating the main parts removed from the bike.

Another feature of this invention is that the bike frame 10 is removable. As shown in FIGS. 1 and 5, the bike frame 10 includes a main frame 11, a handle supporter 12 and saddle supporter 62, 63 wherein the joint means has a first plate 101 fixed at the top of the main frame 11 and a second plate 102 fixed at the handle supporter 12 and each provides joint sleeves 111 and 121 on the top of plates 101 and 102, respectively, for the bolt 112 and nut 122 being fixed together and removed apart. The lower supporter 120 of the handle supporter 12 is inserted in the top of front supporter 13 of the main frame 11 and is fixed with a removable bolt 113 and a nut 123 which is firmly fixed on the supporter 13. For the purpose of security, the connection of main frame 11, handle supporter 12 and front supporter 13 is made by providing a connecting rod 125 at the connection end of the handle supporter 12 (or of the main frame 11 and front supporter 13) to make their connections firm and easy. When the bolts 113 (see FIG. 1) and 112 (see FIGS. 1 and 4), and the joint pin 712 (see FIG. 2) of the handle bar 71 are all removed, the handle supporter 12 can be knocked down from the main frame 11 and the front supporter 13. Again, when the supporting rod 61 of the saddle 60 is removed from the rear supporter 62 and front supporter 63 of the saddle 60 by pulling the keyed pins 620 and 630 and the hinged shaft 631 of the front supporter 63 of the saddle 60 fixed on the main frame 11 is removed, the saddle 60 and the front supporter 63 can be knocked down from the frame 11. In this manner, the rear supporter 62 of the saddle 60 may be further turned to the main frame 11 and folded in the main frame 11 (as shown in FIG. 5). After such knockdown and folding, the volume of the exercise bike of the present invention will be reduced for easy packing, transport and warehousing.

This invention makes the use of transmission box 30, universal joint means 40 and connecting rod 50 to operate the saddle 60 and the handle 70 in a desired manner. The construction of the exercise bike of the present invention is made as simple as possible. This makes production easier and costs less without hampering the multiple function of the exercise bike for body building purpoes. The bike frame can be removed and folded, and the volume is thus reduced to make packing, transport and warehousing much easier.

I claim:

1. A folding exercise bike comprising a bike frame including a main frame, a handle supporter and a saddle supporter;

a handle including two handle bars rotatably inserted into said handle supporter, a lower end of said two handle bars being fixed with a joint means;

a saddle provided at a top portion of said saddle supporter;

a transmission box fixed on a lower part of said bike frame, a main driving shaft extending through said transmission box, each end of said driving shaft being provided with a pedal for pedalling;

a rotating bush means provided on an output shaft of said transmission box;

a universal joint means, one end of said universal joint means being rotatably fixed to said rotating bush means on said output shaft of said transmission box and another end of said universal joint means being pivotally connected to a lower portion of said saddle supporter;

a driving wheel fixed on said driving shaft of said transmission box;

a driven wheel means including a driven wheel, a shaft and a gear, said driven wheel means being rotatably fixed on said lower part of said bike frame and operatively connected with said driving wheel by means of a chain and said gear;

connecting rods having one end connected with said lower portion of said saddle supporter and having another end rotatably connected to said lower end of said handle bars by said joint means;

so that when pedaling, said main driving shaft drives said driven wheel, said driving wheel, and output shaft of said transmission box, said rotating bush means in turn drives said universal joint means to enable said saddle supporter to move forward and backward gradually, and said connecting rods simultaneously rotating said two handle bars inward and outward gradually.

2. A folding exercise bike as defined in claim 1, wherein said main frame, said saddle supporter and said handle supporter are removably connected together and a joint means provided between connecting portions of said main frame and said handle supporter including a first supporting plate fixed with a removable bolt and a second supporting plate fixed with a removable nut so that by the removal of said joint means, said two handle bars will allow said connecting rod to be removed from said handle bar and said handle supporter to be removed from said main frame.

3. A folding exercise bike as defined in claim 1, wherein upon removal of a hinged shaft from said saddle supporter, a front support of said saddle supporter is removed from said main frame, and a rear supporter of said saddle supporter is folded to the main frame.

* * * * *